US006736250B2

(12) United States Patent
Mattice

(10) Patent No.: US 6,736,250 B2
(45) Date of Patent: May 18, 2004

(54) METHOD AND APPARATUS FOR FRAUD DETECTION

(76) Inventor: Harold E. Mattice, 1271 Bolivia Way, Gardnerville, NV (US) 89410

( * ) Notice: Subject to any disclaimer, the term of this patent is extended or adjusted under 35 U.S.C. 154(b) by 93 days.

(21) Appl. No.: 09/967,424

(22) Filed: Sep. 28, 2001

(65) Prior Publication Data

US 2003/0062243 A1 Apr. 3, 2003

(51) Int. Cl.[7] ..... G07D 5/08
(52) U.S. Cl. ..... 194/203; 194/317
(58) Field of Search ..... 194/202, 203, 194/317, 207

(56) References Cited

U.S. PATENT DOCUMENTS 3,998,309 A * 12/1976 Mandas et al. ..... 194/203
4,298,116 A * 11/1981 Niemeyer ..... 194/203
4,583,082 A 4/1986 Naylor
4,673,270 A * 6/1987 Gordon ..... 385/42
5,383,546 A * 1/1995 Mulder ..... 194/203
5,797,475 A * 8/1998 Bointon et al. ..... 194/317
5,823,315 A * 10/1998 Hoffman et al. ..... 194/203
5,931,731 A 8/1999 Chwalisz
6,003,651 A 12/1999 Waller et al. ..... 194/202
6,050,387 A * 4/2000 Iwaki ..... 194/207
6,417,471 B1 * 7/2002 Rompel ..... 209/577

* cited by examiner

*Primary Examiner*—F. J. Bartuska
(74) *Attorney, Agent, or Firm*—Marshall, Gerstein & Borun LLP

(57) ABSTRACT

A system for detection of fraud upon a coin or token accepting device is disclosed. In one embodiment the system operates in a coin path, the coin path being configured to accept and direct a coin. Prior to credit being provided for a coin or other item of value, the system detects and analyzes behavior of objects in the coin path. In one embodiment, one or more emitter/detector pairs are located in the coin path. The emitters transmit a form of energy across the coin path for detection by a detector. A fraud perpetration device in the coin path can be detected by the emitter/detector pairs. The emitter/detector pairs may utilize complex signal schemes, such as signal modulation, random signaling generation, velocity, acceleration, displacement, coin material physics, and the like to detect fraud.

21 Claims, 11 Drawing Sheets

RST=1
N
RST=0
Start_up
950
910
A_in=0
B_in=0
C_in=0
A_out=0
B_out=0
C_out=0
920
Wait
924
bounce_into_C
A_out=0
B_out=0
C_out=1
A_in=0
B_in=0
C_in=1
A_in=1
B_in=0
C_in=0
A_out=1
B_out=0
C_out=0
932
930
in_A
934
A_in=1
B_in=1
C_in=0
Tilt_6
931
912
A_in=1
B_in=1
C_in=0
Good_Coin_1
ZZ
924
in_AB
A_out=1
B_out=1
C_out=0
A_in=1
B_in=1
C_in=1
YY
942
946
Tilt_1
940
bounce_off_B
XX
WW
VV
UU
QQ

METHOD AND APPARATUS FOR FRAUD DETECTION

FIELD OF THE INVENTION

The present invention relates to fraud protection of a coin, token, or bill accepting device and in particular to a method and apparatus for coin, token, or bill sensing.

BACKGROUND OF THE INVENTION

Numerous devices are configured to directly accept money, in the form of coins, tokens, or bills. These types of devices include gaming machines, such as devices configured to provide a gambling or wagering event, vending machines, meters, access control systems, and lottery machines. Configuring a device to directly accept money provides the advantage of attendant free operation and conveniences to the user. For example, a device capable of directly accepting money need not be monitored or continually attended by a cashier and, as a result, the cost associated with such a device is reduced and its hours of available operation increased. Most devices configured to accept money provide something of value in exchange for the coin, token, or bill (collectively money) provided by the purchaser, user or player.

While devices configured to accept monies directly from a user provide several advantages, there are also several drawbacks associated with non-attended money accepting devices. While these disadvantages are evident in general to all such devices that directly accept money, they are discussed below in the example environment of a gaming machine, such as a gaming or lottery machine configured to offer a gambling or wagering event. The gaming machine may be found in a casino or other location offering gambling, such as a bar or restaurant. In this type of gaming environment there may be hundreds or thousands of games with relatively few monitoring personal on the floor to monitor the gaming machines. As a result, dishonest individuals, or teams of dishonest individuals may attempt to defraud the gaming machines by taking advantage of the machines direct money accepting capability.

Various methods and apparatus exist to defraud these types of gaming machines. For example money may be modified by attaching a string or cord thereto to forcefully retrieve the money from the machine after credit has been registered on the machine. Similarly, the money may be attached to a flexible shiv and, after credit provided, retrieved from the gaming machine. This process may be repeated numerous times thereby generating credit on the gaming machine. The credits may then be cashed out or redeemed for cash or credit. It is difficult for personnel on the floor to detect or prevent this type of fraud because of the disproportionately large number of gaming machines as compared to the number of monitoring personnel.

To counter and prevent the acts of fraud on the gaming machines, several fraud prevention devices have been proposed for inclusion into the gaming machines. One such device comprises a light source that generates a steady state signal that is always on and a light detector aligned across a coin path. Improper interruption of the light at the light detector may cause a coin to not be accepted. Another fraud prevention feature is to link the output of light detector to the gaming machine operating system. The operating system then continually monitors the data input from the light detector and is suppose to tilt the machine based on the results of the monitoring.

While these proposed solutions were at first effective, the more determined fraud perpetrators were able to overcome these fraud prevention hurdles. These fraud prevention system were able to be overcome because of drawbacks in the system. The fraud perpetrators were able to construct fraud devices capable of generating a light signal or were able to construct the shiv out a clear material that allowed the light signal to pass. Further, the gaming machine operating system was often overloaded and thus unable to accurately track the numerous data inputs from the fraud system. Hence the fraud went undetected.

As a result of the drawbacks of the prior art, there is a need for a fraud detection and prevention system that overcomes the method and apparatus employed by advanced fraud perpetrators.

SUMMARY OF THE INVENTION

The invention comprises a method and apparatus for monitoring a coin, token or bill path in a device configured to accept money from a user. As part of the monitoring the behavior of the coin, token, or bill and its progression through the path may be closely analyzed for behavior or for items that may reside or block the coin path. By closely analyzing the behavior of items passing through or residing in the coin path, fraud can be detected. Various embodiments of the invention may include a coin path with multiple emitters and/or detectors, signal generation and processing electronics, optical sensors, frequency to voltage convertors, modulators, and/or pizo-electric devices. The invention is discussed below in greater detail.

In one embodiment, a system for detecting fraudulent coin or token submission to a gaming device is configured with one or more light sources configured to generate light energy, and one or more light detectors configured to detect the light energy. Also included are one or more modulators configured to generate and provide one or more modulated signals to the one or more light sources and a controller connected to at least one of the one or more modulators and at least one of the one or more light detectors.

In addition, the light energy may be selected from the group consisting of light in the ultraviolet, infrared, or visible spectrum. The system may also include one or more electro-optical convertors between the one or more light detectors and the controller. In addition, the controller may also include compare logic configured to receive and compare the output from the one or more light detectors with output of the modulator.

In another embodiment a coin detector with a fraud detection capability is provided that comprises a coin detector having a coin rake that is movable between a first position and range of other positions. Also included is an emitter configured to emit light energy and a receiver located to receive light energy from the emitter; said receiving light energy dependant on the position of the coin rake. Also included is a controller configured to analyze data from the receiver and the coin detector to thereby determine the position of the coin rake.

It is further contemplated that this system may include a frequency to voltage converter configured to convert the signal having a voltage to a signal that is directly related to the frequency. The receiver may comprises a light sensor and the emitter may comprise a light emitting diode. In one embodiment the system further includes a timer and comparator configured to time the duration that the coin rake is in other than the first position and a comparator to compare the time the duration to a stored value to determine if an object is preventing the coin rake from returning to the first position.

Yet other aspect of the invention includes a method for detecting an object in a coin path comprising monitoring a coin rake detector to determine the position of the coin rake detector wherein the coin rake detector movable between a first position and second position and then timing the period between when the coin rake moves from the first position to when the coin rake returns to the first position. Thereafter, comparing the period to a stored value representative of a known duration for a valid coin to pass through the coin rake and generating a signal if the comparing determines the period exceeds the known duration. If the comparing determines that the period exceeds the known duration then fraud may be occurring.

This method may also operate where the coin rake detector comprise a emitter/receiver pair configured to monitor the position of the coin rake and/or where the first position is the position assumed by the coin rake when a coin or token is not passing through the coin rake. In one embodiment the method further includes the step of actuating the coin rake upon detection of a fraudulent event.

In another embodiment a system is provided for detecting fraudulent coin or token submission to a gaming device comprising one or more energy sources configured to emit energy, the energy sources receiving one or more inputs, and one or more energy detectors configured to detect energy emitted from the one or more energy sources and generate an electrical signal representative of the detected energy. Also included is at least one frequency to voltage convertor configured to generate a signal having a voltage level dependant on the frequency of the electrical signal from the receiver and a controller configured to receive the signal having a voltage level and to provide one or more inputs to the one or more energy sources. The controller is further configured to compare the one or more inputs to the signal having a voltage level to determine if fraud is occurring.

In addition, the system may be configured such that energy sources comprise a light source and the energy detectors comprise light detectors. The controller may comprise a comparator and a frequency generator. The system may further include a modulator configured to receive the one or more inputs from the controller to the energy sources and provide modulated inputs to the one or more energy sources. The light energy may be selected from the group consisting of light in the ultraviolet, infrared, or visible spectrum. In addition, the system may further include one or more electro-optical convertors between the one or more light detectors and the controller. The controller may further include compare logic configured to receive and compare the output from the one or more light detectors with output of the modulator.

In yet another embodiment, a fraud prevention system is provided for inclusion in a coin path of a device configured to accept and provide credits for coins or tokens. In such an embodiment system comprises a coin path configured to direct a coin between one or more guides and a detector located within the coin path. The detector is configure to be activated by the passage of a object to thereby generate an output. Also included is a comparator configured to compare the output of the detector to a valid detector output to determine if passage of the object was an event for which credit will be provided.

In variations of this system, the detector comprises a pizo-electric device or the valid detector output comprises a range of valid detector outputs generated by activation of the detector by the passage of a valid coin or token.

DETAILED DESCRIPTION OF THE INVENTION

The invention is a fraud prevention/detection system, and more particularly a method and apparatus for coin, token or bill sensing. In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention. It is contemplated that the features or elements of the invention may be embodied alone or in any combination.

Figure 1:
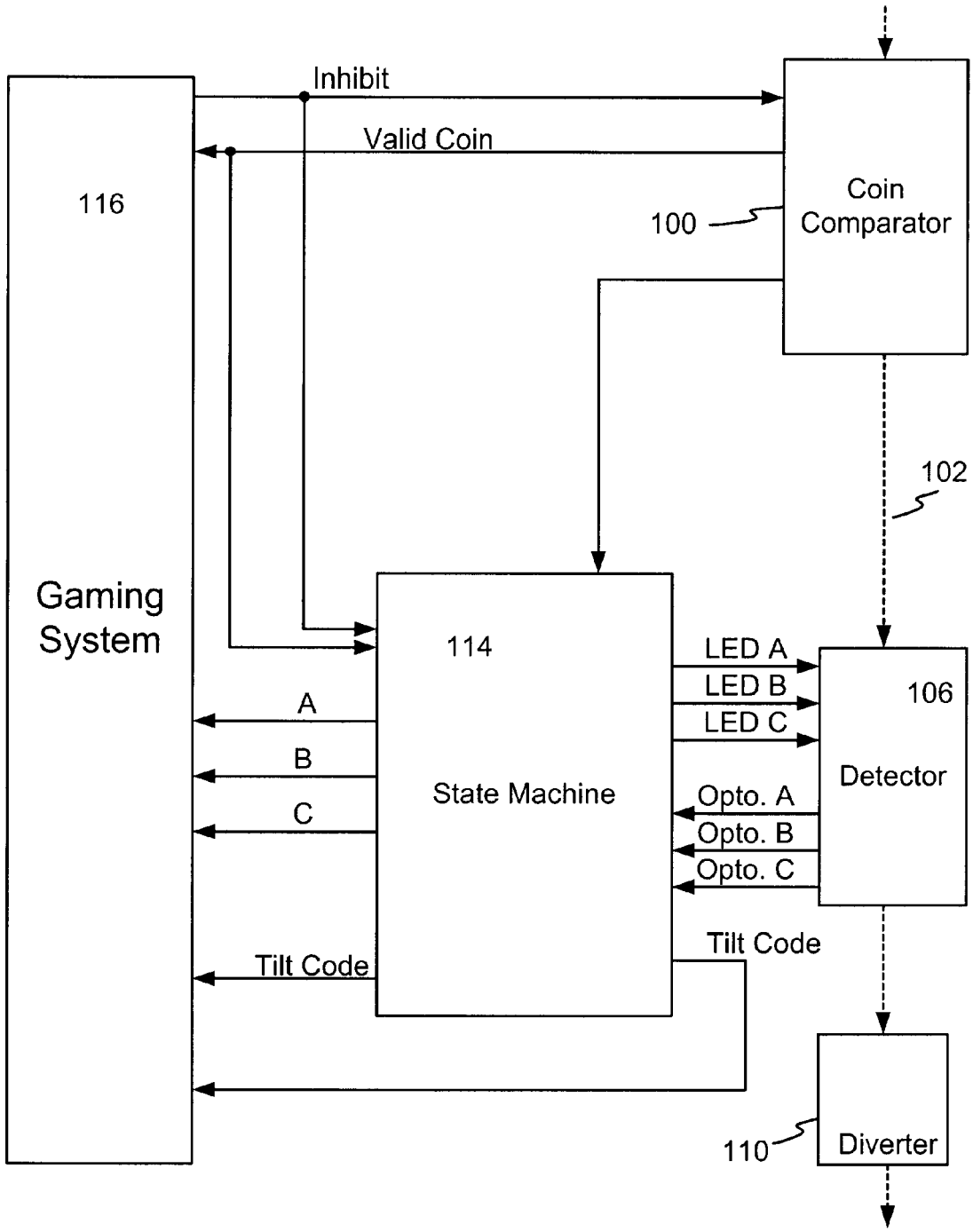
FIG. 1 illustrates an example embodiment of one embodiment of the invention.

FIG. 1 illustrates an example embodiment of one embodiment of the invention in the environment of a gaming machine. Although shown in the environment of a gaming machine, it is contemplated that the fraud prevention/detection system described herein may find application in any device configured to directly accept money or tokens. An embodiment of the invention, a coin comparator 100 is configured to analyze a coin placed in a coin path 102. The coin path 102 is shown by the dashed line 102. The coin path 102 also encounters a detector 106 and a diverter 110. The detector 106 comprises a coin detection and monitoring device. In one embodiment the detector comprises one or more light emitting devices matched to one or more light detecting devices. The light emitting devices emit light across the coin path to be received by a light detecting device. When the coin passes through the detector 106 the light path is interrupted by the passage of the coin. As a result, the output of the light detector provides evidence of the coin's passage.

The physical diverter 110 comprises a physical device configured to physically divert a coin based on communications from a state machine 114, coin comparator 100, and/or the detector 106. If the coin comparator 100 or the detector 106 determine the coin to be fraudulent or of an unacceptable type then these devices 100, 106 may cause the physical diverter to prevent credit for the coin. The physical diverter 110 may divert the coin to a coin return area. In one embodiment the physical diverter utilizes a relay controlled coin rake to divert the coin. If the coin is able to pass through the physical diverter 110, then credit may be provided for the coin.

In the example embodiment shown in FIG. 1, the coin comparator 100 connects to a state machine 114 and a gaming system 116. A valid coin signal line and an inhibit line connect the coin comparator 100 to the gaming system 116 and to the state machine 114. The inhibit line may carry signals to the coin comparator 100 and the state machine 114 that cause the comparator to not accept coins. The comparator may include a coin diverter configured to divert the coin to a coin return. This may occur in the event of a problem with the gaming system, and hence coins may be routed directly to the coin return. The valid coin line carries signals to the gaming system 116 and the state machine when a valid coin has passed through the comparator 100. The coin comparator 100 also connects to the state machine 114 for exchange of information there between.

The state machine 114 comprises a configuration of logic, comparators, processor, memory or other electronic components configured to provide signals to and receive signals from the detector 106. The state machine 114 is further configured to analyze or process the input from the detector 106. In the embodiment shown in FIG. 1, the state machine 114 includes a signal generator that provides signals to the light generators of the detector 106. In turn, the light generators generate light signals which may be detected by the light detectors. The output of the light detectors is provided to the state machine 114 for analysis. The state machine 114 also outputs values to the gaming system 116. In this embodiment the state machine 114 provides outputs to the gaming system 116. In one configuration the state machine 114 provides outputs A, B, C to the gaming system 116. In such an embodiment the gaming system 116 analyzes the signals on lines A, B, C to determine if fraud may be occurring. In another embodiment the state machine 114 provides a tilt signal output to the gaming system 116. In the embodiment including a tilt signal, the state machine 114 performs the processing to determine if fraud may be occurring instead of the gaming system 116 performing the processing. Having the state machine 114 perform the processing may be an advantages in that the processing is performed by a dedicated fraud prevention device. As a result, the gaming system 116 can not neglect or fail to process the fraud data if it becomes overloaded or misprogrammed. If this were to occur, fraud may not be detected. In actual practice, it may not be necessary to provide both outputs A, B, C and the tilt code to the gaming system 116.

The state machine 114 also connects to the output of the physical diverter 110 so that it may provide signals to the diverter 110 to cause a coin to be diverted from the coin path thus preventing credit being provided for the coin. For example, if the comparator 100 or the detector 106 provide signals to the state machine that indicate that other than a valid coin is traveling on the coin path, then the state machine 114 causes the diverter 110 to direct the coin to the coin return and credit is not provided.

Figure 2:
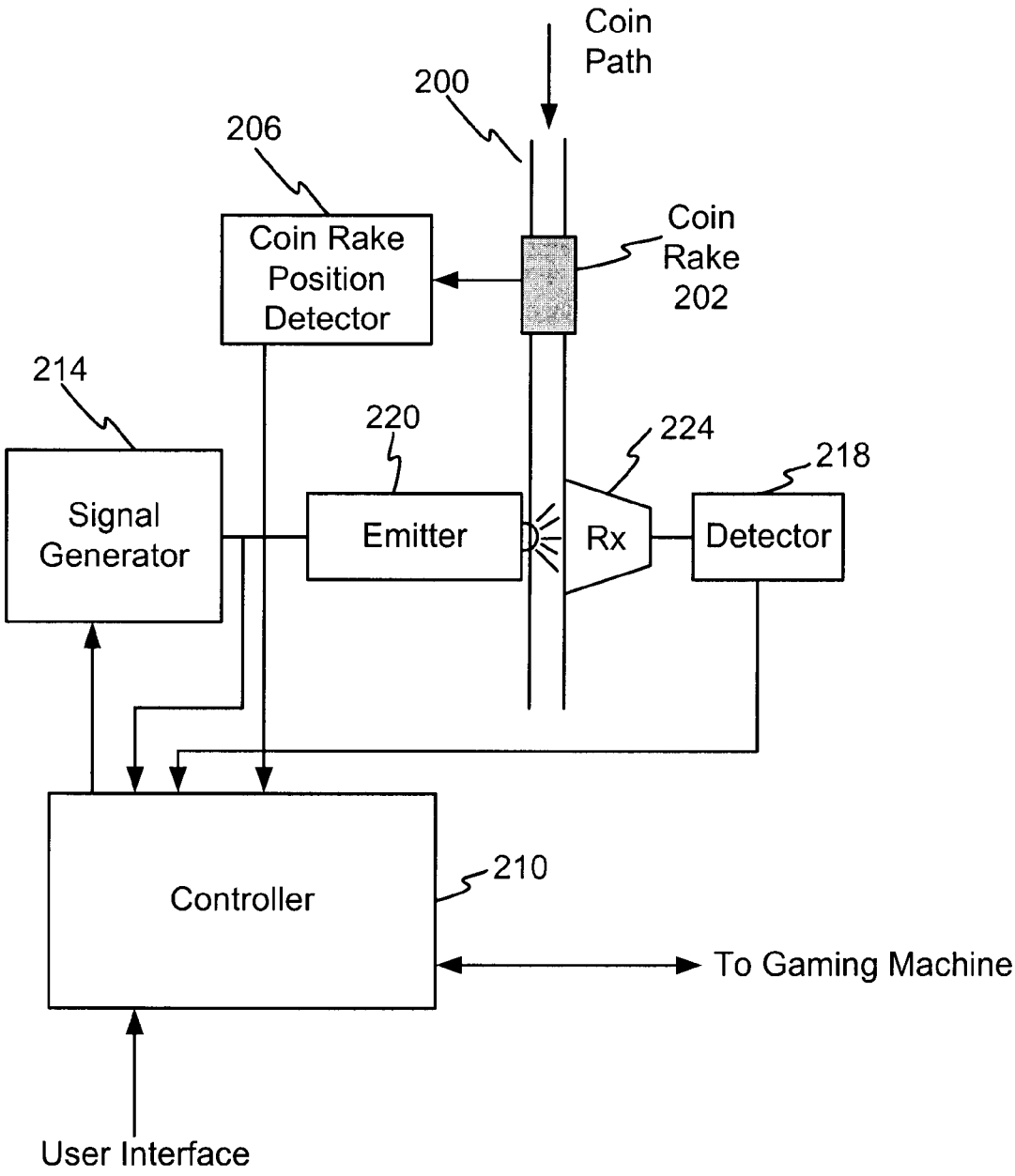
FIG. 2 is a more detailed example of an example embodiment of the invention.

In reference to FIG. 2, a more detailed example is provided of an example embodiment of the invention. Although shown with a single emitter/detector pair, it is contemplated that any number of emitters/detectors may be used without departing from the scope of the invention. A drawback of the prior art is that perpetrators of fraud were able to utilize devices that allowed the light to pass there through or that overcame the fraud preventions systems of the prior art. In the embodiment shown in FIG. 2, the coin path 200 is shown in side view. A coin rake 202, as known in the art, is located in the coin path 200. A coin rake position detector 206 is in communication with the coin rake 202. The coin rake position detector 206 determines the position of the coin rake 202 and provides the position information to a controller 210. The coin rake position detector 206 and the coin rake 202 may be known as rake switch.

The controller may comprise a configuration of logic, processor, comparators, registers, processor, CPU, or other electronic apparatus configured to oversee and guide operation of the system shown in FIG. 2. In one embodiment the controller comprises a Xilink XC9572 integrated circuit available from XILINX located in San Jose, Calif. In another embodiment the controller comprises an Intel 89C51 embedded controller.

The controller 210 is also in communication with a signal generator 214 and a detector 218. The controller 210 provides signals to or communicates with the signal generator 214 and receives signals from the detector. In one embodiment the controller 210 initiates operation of the signal generator 214 and receives the output from the signal generator. In one embodiment the controller includes a modulator (not shown). The output of signal generator 214 is also provided to an emitter 220. The emitter 220 comprises any device capable of emitting energy sufficient to reach and be detected by the receiver 224. The emitter 220 may be an emitter configured to generate types of energy including but not limited, to light energy in the visible spectrum, ultraviolet light energy, infrared light energy, ultrasonic energy, radio frequency or radio energy (including microwave, or any other frequency band of electromagnetic radiation or fields, magnetic switches and mechanical switches. It is contemplated that the receiver 224 be matched to the emitter 220 such that the receiver is capable of receiving the energy emitted from the emitter. The receiver 224 has an output connected to the detector 218. In one embodiment (not shown) the detector 218 and receiver 224 are combined in to a single unit. The output of the detector 218 feeds into the controller 210. It is further contemplated that the energy path between the emitter 220 and the receiver 224 may be intermittently blocked or modified by passage of a coin through the coin path or by the presence of an apparatus or substance in the coin path at the point between the emitter and the receiver.

Operation of the apparatus of FIG. 2, independent of a coin passing through the coin path is now described. The controller 210 initiates signal generation by the signal generator 214, which is configured to generator a signal. Any type of signal may be generated including but not limited to a pulse signal, modulated signal, DC signal, sinusoidal, or any combination thereof. Hence, a modulated or pulse signal may include a DC offset. It is further contemplated that the signal generator may include a random number generator to thereby provide as an output a randomly generator number. Any order of magnitude of randomly generator number may be utilized.

The output of the signal generator 214 feeds into the emitter 220 and back into the controller 210. The generator output feed back into the controller serves as a reference signal. The emitter 220 transforms the signal into a form of energy capable of spanning coin path and reaching a detector, yet capable of being blocked by passage of a coin, token or other item in the coin path. In one embodiment this comprises light energy. The receiver 224 detects the energy, and in conjunction with the detector 218 generates a corresponding electrical signal (the received signal) which in turn is provided back to the controller 210.

The controller 210 compares the received signal to the reference signal that was received directly from the signal generator 214. The comparison may include comparison of factors such as the signal pattern, the signal intensity, signal reflections, signal delay, rate of change, phase, amplitude or any other factor. It is thus contemplated that signal generator 214 includes means to change the signal over time, such as through modulation or random signal generator. If a signal is not being received by the detector, then it can be assumed that an item, possibly a coin, is in the coin path, and in particular in the area of the coin path between the emitter/detector pair. A comparison may also occur between the signal provided to the emitter, i.e. the signal transmitted from the emitter, and the signal received by the detector. If these signals differ, then fraud may be occurring in that a fraud device having an incorporated 'fraudulent emitter' that is placed in the coin path to generate credits while deceiving the detector into behaving as if the detector was receiving the signal from the emitter. These fraud device with incorporated 'fraudulent emitter' are built by high-tech cheats to fool a fraud prevention device. However, in the embodiments described herein incorporating a signal generator 214 capable of changing the signal over time or providing other than a constant signal as an output, such as a modulated signal or a signal modulated based on a random number generated scheme, such a fraud device would be detected. Hence, it may be desirable to modulate or other wise change the signal sent from the emitter and compare this signal to the signal received from the detector.

The position of the coin rake detector 206 may also be used by the controller to determine if an item is in the coin path. One advantage of varying the signal generator output is that such reduces the likelihood of a fraud being perpetrated on the machine.

One exemplary method of operation when a coin passes through the coin path is as follows. As the coin path passes through the coin rake 202 a signal is generated by the coin rake position detector 206. This signal is provided to the controller 210. Time elapses between when the coin rake detects passage of the coin and when the emitter 220 and receiver 224 detect passage of the coin.

As the coin passes down the coin path it interrupts the flow of energy between the emitter 220 and receiver 224. Based on the duration of interruption, fraud may be detected. As discussed below, coin travel through the coin path can be characterized or modeled and stored as acceptable coin travel parameters. Coin travel is defined to mean the characteristics of the coin progression through the coin path. Coin travel may include but is not limited to rate of travel, bounces, reverse progression, side to side motion, stoppages, rate of change of travel (ie. acceleration/deceleration) and vibration rotation. During actual operation of the device, the coin travel may be monitored and recorded. In one embodiment the duration, i.e. time period, that the coin rake (coin detector) is in other than the default position is timed to create coin rake actuated time value. In one embodiment the emitters/detector pairs are monitored for a period when the detectors do not receive a signal. This time period is timed and the value may be stored as a emitter blocked time value.

It is further contemplated that the fraud detection system be equipped with stored values that represent values of valid coin travel characteristics. In one embodiment known valid coins are provided to the coin path and the characteristics of the coin travel are recorded. For example, for each denomination of coin, valid coin travel characteristics are detected, recorded, and stored. These coin travel characteristics that are known to be valid are stored as values in the fraud system. In one embodiments the coin rake behavior upon passage of a valid coin is monitored and recorded. In one embodiment the duration of passage of a known valid coin by an emitter/detector pair is monitored and recorded. In one embodiment the timing and pattern of coin travel between two or more emitter/detector pairs from passage of a known valid coin is monitored and recorded. In one embodiment the output of a valid emitter signal is stored as a known valid emitter output. It is contemplated the valid outputs or time durations that are recorded may be a range of values as it is understood that there will be variation between valid signals. Hence to obtain the valid range numerous coin passages may occur and be monitored and recorded. Thus, for purposes of discussion, there may be stored coin travel parameter values, that are known to be valid, and actual coin travel parameters, for which validity is to be determined.

By comparing the actual coin travel parameters to stored coin travel parameters fraud may be detected. For example, the time it takes for coin passage through the coin rake is recorded as an actual coin rake passage time value. The actual coin rake passage value is then compared to the stored (valid) coin rake passage time value. If the actual is not within the parameters of the stored values then the passage is considered to be fraudulent. A similar process may occur for the other parameters, including but not limited to coin passage between the emitter/detector pair and the coin travel parameters for two or more emitter/detector pairs. A comparison may also occur between the signal received by the detector(s) and the signal output from the emitter or a stored valid detector signal. If the coin passes too slowly, too rapidly, or in a non-valid path, then fraud may be occurring and an indication of fraud is be provided. Similarly, if the signal received by the detector is not generally identical to the signal from the emitter, then fraud may be occurring. A detailed and exemplary operational flow diagram is provided below. It should be noted that there are numerous other methods of using the invention to detect fraud.

With regard to the comparison between a stored valid value and an actual value of unknown validity, if the actual value is outside the stored valid parameters, then the coin may be considered other than a valid coin. Credit for the coin is not provided and the coin may be directed to a coin return, if in fact a coin was actually in the coin path. The comparison is discussed below in greater detail and based on the discussion herein should be understood by one of ordinary skill in the art.

The invention as described herein is not limited to any particular denomination of coin or a mint issued coin. It is fully contemplated that the invention may be implemented for use in systems configured to accept coins, tokens, paper money or receipts, cards, or any item representing money, credit, value, or merchandise. In these various embodiment adapted for other than a coin, the other aspects of the invention may be likewise adjusted. For example, and without limitation, the coin path may instead be a bill path, token path, or any other router adapted to direct an item.

Figure 3:
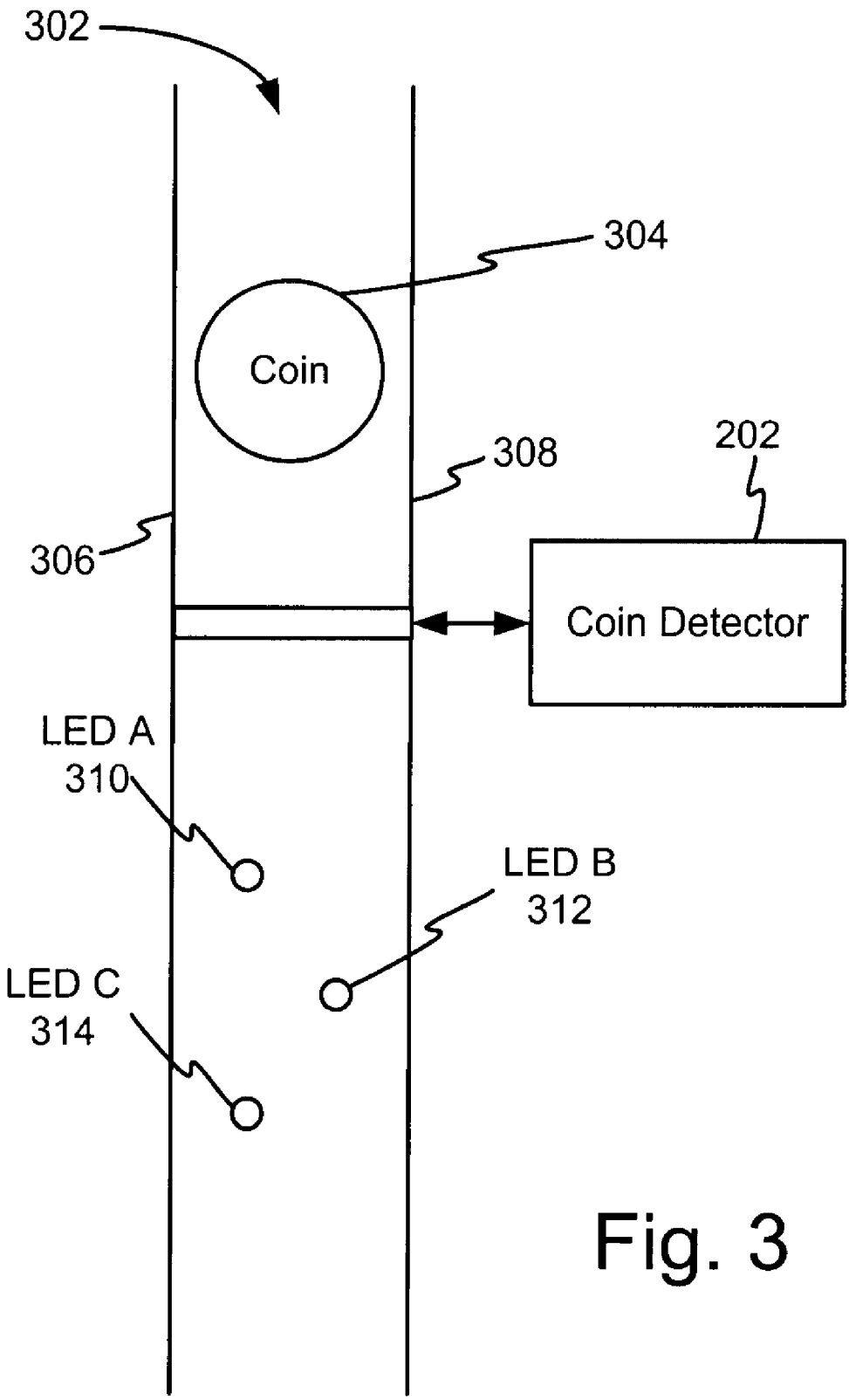
FIG. 3 illustrates an exemplary embodiment of a multiple emitter configuration.

FIG. 3 illustrates an exemplary embodiment of a multiple emitter configuration. As it is contemplated that any number of emitters and/or detector may be used, the invention is not limited to the particular number of emitters shown or the exact configuration shown. Further, it is contemplated the more than the ratio of emitters to detectors may not be one to one. As a detector may be configured to detect output from more than one emitter, or a single detector could receive from more than one emitter, it is contemplated any number of emitters not match the number of detectors. As shown, a coin path 302 is sized to accept a coin 304. It is contemplated that the coin path include a first side 306 and a second side 308 that the coin 304 may contact. In this example embodiment light emitting diodes are selected for the emitters. A first LED 310, a second LED 312, and a third LED 314 are arranged in a generally triangular manner. Any configuration may be selected, although the triangular pattern provides the advantage of providing good logical patterns when two coins are in the coin path. Progression of a coin through the configuration shown in FIG. 3 is described below in conjunction with FIG. 10.

Figure 4:
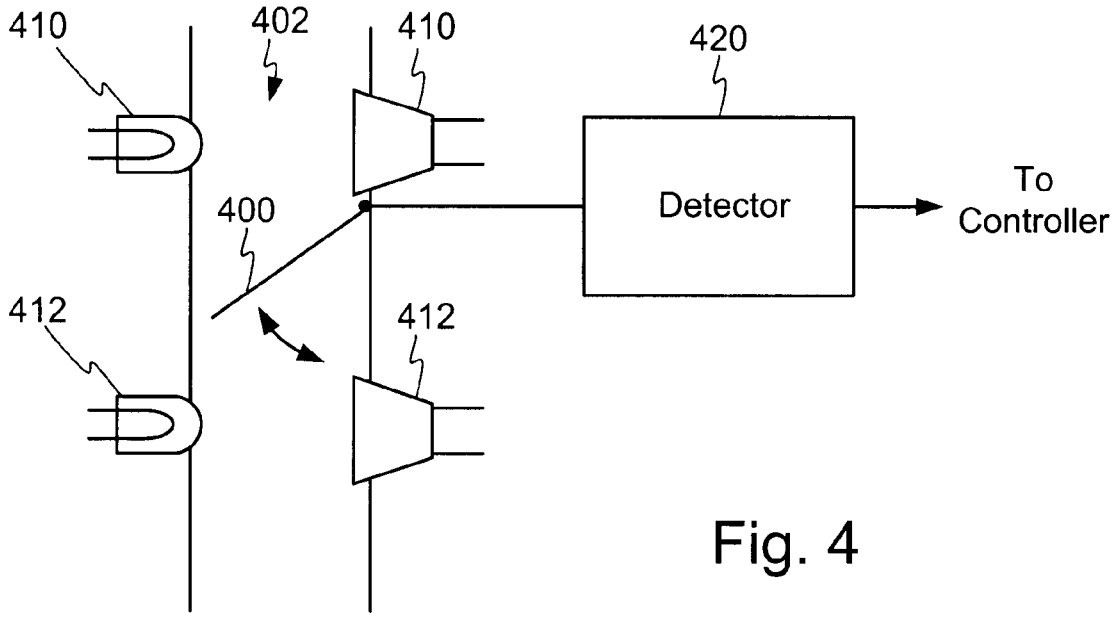
FIG. 4 illustrates another embodiment of the invention incorporating a flapper or hinged detector arm.

FIG. 4 illustrates another embodiment of the invention incorporating a flapper or hinged detector arm. The arm 400 resides in a coin path 402. In FIG. 4 the arm is located between a first emitter/detector pair 410 and a second emitter/detector pair 412. In other embodiment the arm 400 may reside before the emitters and detectors and/or after the emitters and detectors.

The arm 400 is coupled, connected, or monitored by a detector 420 that monitors for actuation of the arm by a coin or any other device passing through the coin path 402. The detector 420 provides an electrical signal to a controller or other device configured to make fraud decisions. It is further contemplated that more than one arm/detector pair may be placed in the coin path 402. The arm/detector pair may comprise a pizo-electric device.

The use of an arm 400 and detector 420 in the coin path 402 in conjunction with the emitter/detector pairs 410, 412 provides an advantage when detecting fraud in that the passage of a coin through the coin path creates a different signal generation by the arm and detector than does a fraud device permanently placed in the coin path, because the fraud device can not accurately represent the movement of a coin. Similarly, if an attempt to withdraw a coin or other object from the coin path is made, the arm 400 and detector 420 can register the backward movement of the object through the coin path.

In one configuration a detector, such as a emitter/receiver pair, is installed in the coin or token reject path. As is commonly understood, if a coin or token is not accepted as a valid coin or token, for whatever reason, it is physically directed to a rejection coin path which guides it back to the customer. By locating a detector in the rejection coin path the fraud prevention system knows if the detection of an invalid object in the coin path and resulting rejection operation caused anything, such as a coin or token to be directed to the coin path. If a coin or token passes through the rejection coin path, then the source of the possible fraud is likely an invalid coin or something that can be diverted to the coin path. In contrast, if, upon occurrence of a fraud detection, a coin or token does not subsequently pass through the rejection coin path, that some event or device is causing the fraud system to activate other than a coin or token in the path. It may be desirable to signal an alert or know when a device other than a coin or token is in the coin path. By way of example and not limitation, if a strung coin or a fraud device on a piece of plastic is inserted into the coin path to perpetrate fraud on the machine, then a coin will not be directed to the rejection coin path. By knowing that a coin or token did not pass through the rejection coin path, insight may be gained as to the type of fraud being attempted on the machine.

In one configuration an oscillator circuit is adopted for used in the rejection coin path. The oscillator circuit may change the output voltage as a function of a metallic object being in the rejection coin path. One of ordinary skill in the art is familiar with a metallic sensing circuit and hence it is not described in great detail herein. In another embodiments any of the detection or emitter/receiver system described herein are adopted for use in the rejection coin path.

In an alternative embodiment to that shown in FIG. 4, the arm and detector incorporate or are replaced by a pizoelectric device that generates a particular type, duration, frequency or pattern of signals when a non-fraudulent coin passes through the coin path. If a signal is generated that does not fall within the parameters of known and accepted signals generated by a valid coin, the controller may designate the passage as fraudulent and prevent assignment of a play credit.

In another embodiment, a different technology or technologies are utilized to enable the detection and analysis system for use in detecting fraud. These technologies monitor or analyze velocity, acceleration, displacement, coin material physics, and the like to detect fraud. Another embodiment may use emitters/detectors that operate using light as one emitter/detector system in conjunction with one or more of these second technology types. Example of these technologies include, but are not limited to mechanical and magnetic switches (for displacement), ultrasonic sound (for acceleration, velocity and displacement), high frequency oscillators (for acceleration, velocity displacement and coin material physics), and the like for use as the second emitters/detectors. Various embodiments may use any combination of one or more of these emitters/detectors. Thus a first type emitter/detector may comprise to be piezoelectric and the second type emitter/detector may comprise a high frequency oscillator emitter/detector.

It is contemplated that upon detection of fraud, the money acceptance system will not provide credit or product. In addition, a warning or signal may be provided to authorities or to tilt the machine to prevent further attempts at fraud.

Figure 5:
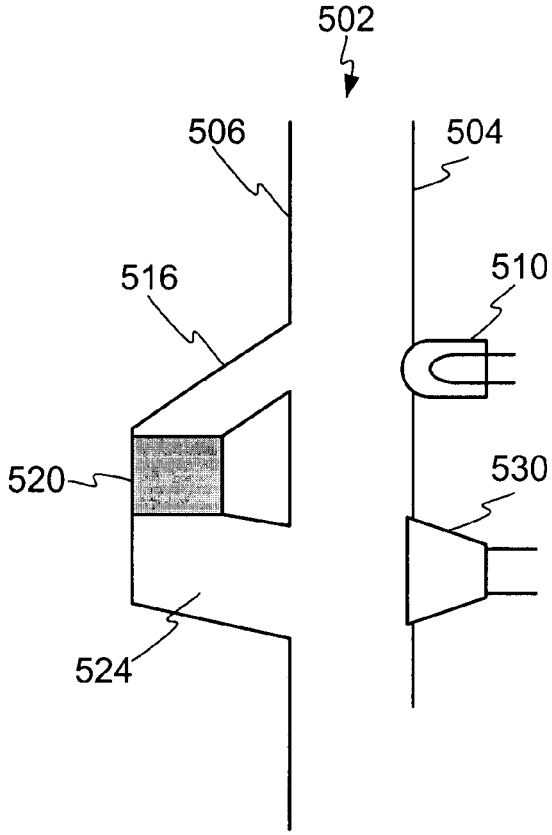
FIG. 5 illustrates an embodiment of the invention including a frequency or wavelength modifier or translator.

FIG. 5 illustrates an embodiment of the invention including a frequency or wavelength modifier or translator. As shown, a coin path 502 provides access for a coin to travel between a first side 504 and a second side 506. In the shown configuration an emitter 510 is mounted at or near the first side 504, In this embodiment the emitter 510 comprises an LED. At or near the second side 506 and generally opposite the emitter 510 is a first channel 516 leading to a frequency modifier 520 or translator. The output of the frequency modifier 520 is provided to a second channel 524, which channels or directs the light toward a receiver 530. Discussion is not provided of apparatus not discussed above. The first channel 516 is reflective or conductive and configured to direct light received from the emitter 510 to the modifier 520. The modifier 520 is a device or substance configured to modify or change the wavelength or frequency of the received energy, in this embodiment light energy. The modified signal is directed by the second channel 524 the detector 530.

The modifier 520 may comprise any apparatus or device capable of receiving one form of energy and outputting another form of energy. Thus, in various embodiments the modifier 520 may change the frequency of radio energy, or the wavelength of light energy, or convert one type of energy to a different type of energy. For example, the modifier may transform light energy into physical energy or into radio energy. In one embodiment the modifier 520 comprises a lithium fluoride crystal that has been radiated with gamma radiation to thereby cause light energy passing through it to exit with a different frequency. Lithium fluoride crystals is available from Sunna Systems Corporation in Richland, Wash. In another embodiment the modifier 520 comprises a photo-electrical device configured to receive optical energy and output a different form or type of energy, such as device configured to detect a first frequency and output a second frequency or output energy from a pizo-electrical device.

Figure 6:
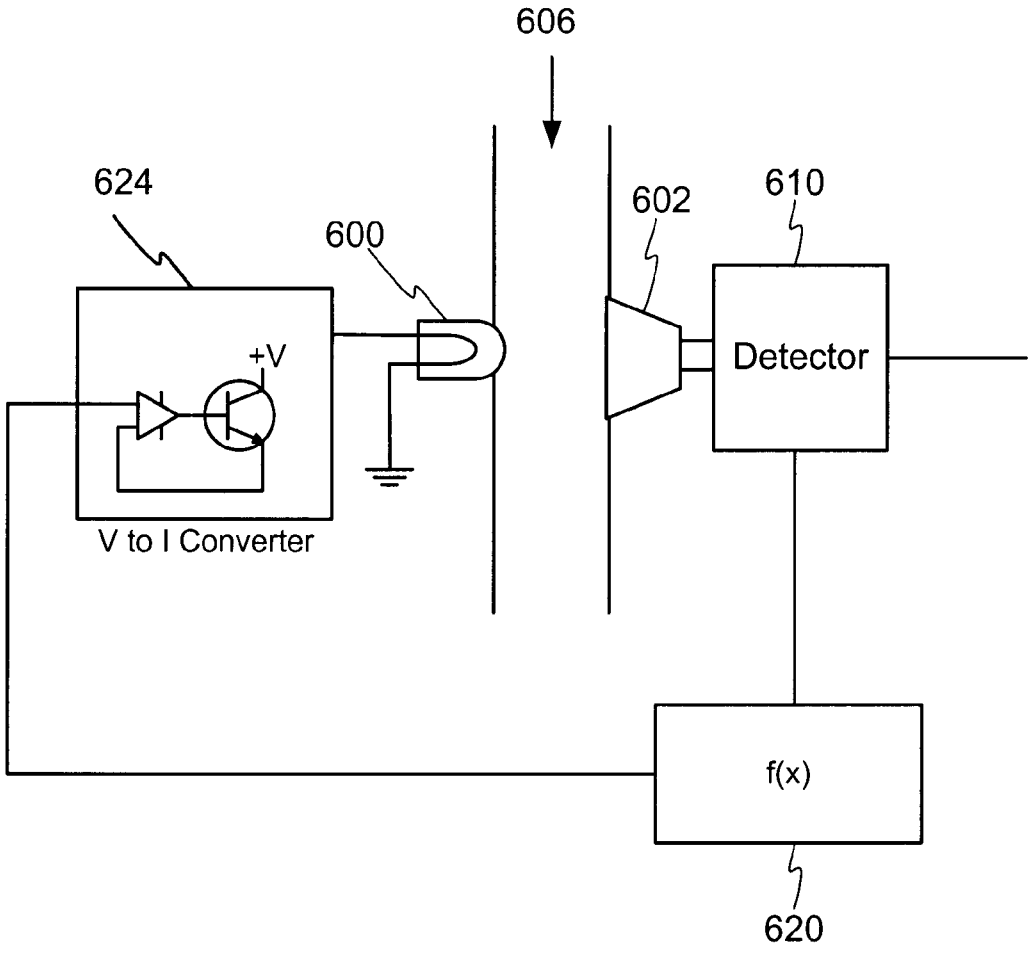
FIG. 6 illustrates an embodiment of a emitter/detector system having a voltage to current feedback loop.

FIG. 6 illustrates an embodiment of a emitter/detector system having a voltage to current feedback loop. As shown the emitter 600 and receiver 602 are separated by a coin path 606. The receiver 602 output connects to a detector 610 that provides an electrical signal representative of the energy received by the receiver 602. The output of the detector 610 feeds into a function generator 620 that performs processing on the input based on the function defined by f(x). The function f(x) may comprise a frequency to voltage convertor, such as by way of example and not limitation, a light to voltage converter. The function f(x) may be varied over time. In one embodiment the function f(x) is defined as:

$$\frac{1}{n}\sum AX_1 + BX_2 + \ldots ZX_N$$

where the values of A, B, . . . Z change over time.

In one embodiment a light to frequency Model number TSL235 is adopted for use that is manufactured by Texas Advanced Optoelectronic Solutions located in Plano, Tex. It is contemplated that this device may be used for any one of the one or more emitters or detectors in the fraud system.

In one embodiment, the emitter current is a function of a pulse from the control circuitry. As the ratio of the on and off time is varied according the modulation scheme, different currents can be achieved to drive the emitter. In one embodiment the emitter is an LED and the receiver is a phototransistor. This assembly may also have an intensity to frequency function inside the IC. Thus, as the duty cycle of the LED (located on one side of the coin path) is changed, the frequency from the receiver also changes. As a result, a intensity to frequency device is created across the coin path. If a fraud device is placed in the coin path, this tool must reproduce the exact intensity to produce the same frequency that the fraud prevention system would produce. In addition, the change in intensity (duty cycle change) will cause a frequency change thus making it even more difficult to produce a fraud device to copy this function.

The output of the function generator 620 feeds into a voltage to current (V to I) convertor 624. The V to I convertor 624 comprises a circuit or other apparatus that converts the input signal, based on the voltage, to an output signal having corresponding current. As shown, in one embodiment the V to I convertor 624 may comprises a operational amplifier connected with feedback to a transistor having its emitter connected to a supply voltage. The output of the V to I convertor 624 feeds into the emitter 600. In one embodiment the opposite terminal of the emitter is connected to ground. As with the other embodiments the emitter and detector may comprise any type of system capable of emitting or receiving energy. An light emitting diode is one example of an emitter.

In operation, the system shown in FIG. 6 is configured to generate a signal across the coin path 606. Upon detection of the signal by the receiver 602 and the detector 610 the function generator detects the frequency of the received signal from the detector 610 and converts the signal to a signal with a voltage level corresponding to the frequency of the received signal. The frequency to voltage converter may optionally apply a function defined by f(x) to the received signal before providing an output. The V to I convertor 624 then converts the signal to drive the emitter 600.

Use of a frequency to voltage convertor can provide the advantage of being able to modify the intensity of the signal and the frequency of the signal. This provides an extra layer of security or complexity to prevent fraud. If a device is inserted into the coin path 606, it must be equipped with complex circuit configured to mirror the changing output of the emitter 600.

Figure 7:
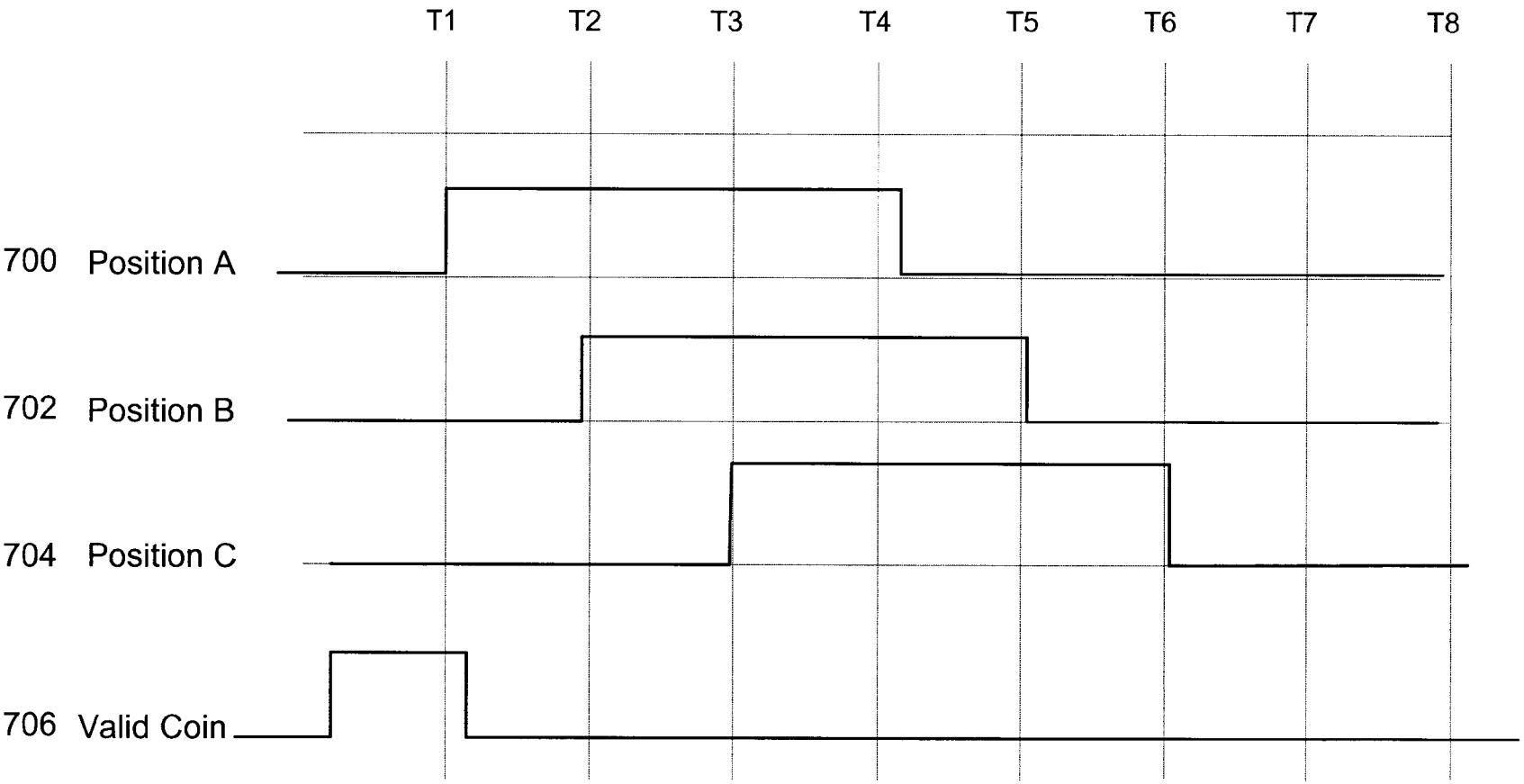
FIG. 7 illustrates an signal plot of an example configuration with three emitter/receiver pairs.

FIG. 7 illustrates a signal plot of an example detector configuration with three emitter/receiver pairs. FIG. 3 provides an example configuration of a configuration with three emitter/receiver pairs and can be referenced in conjunction with this discussion of FIG. 7 to aid in understanding. Four signal plots are provided in FIG. 7. These signal plots are emitter A signal 700, emitter B signal 702, emitter C signal 704, and valid coin signal 706. The plot of FIG. 7 is exemplary of a output of the emitter/receiver system and the coin detector as might be used to track progression of a coin through the coin path and be analyzed for fraud detection. The top of the plot of FIG. 7 is time. Time is represented as a time T1 through time T8.

Progression of an exemplary coin is now discussed in relation to the output of the coin detector and emitters A–C as evidenced by the signal plots shown in FIG. 7. Upon insertion of a coin into the coin path, the coin detector detects the coin and generates a high signal on its output line as shown prior to time T1 at valid coin line 706. If the detection by the coin detector does not fall within specification for a valid coin then the valid coin signal 706 does not go high and credit will not be given for the coin.

As the coin progresses through the coin path, it enters the space between the emitter A and the receiver associated with emitter A. This cases the light to be blocked thereby causing the receiver associated with emitter A to go high. This occurs at a time T1. It is assumed that the receive output is inverted. Thereafter, as the coin progresses through the coin path it enters the space between the emitter B and the receiver associated with emitter B. This occurs at a time T2 and causes the output signal for emitter B 702 to go high as shown. Emitter A signal output 700 is still high at time T2 because the coin is sized to cover both emitter A and emitter B at the same time. At a time T3, the coin blocks the path between emitter C and the receiver associated with emitter C. This causes the output of the receiver associated with emitter C to go high.

As the coin continues through the coin path, it exits the space between the emitter A and its associated receiver causing signal A to go low. As shown this occurs for signal B at a time T5 and for signal C at time T6. Thus FIG. 7 illustrates the receiver outputs for one exemplary output of the detector system of FIG. 3. Although these are exemplary signal outputs of valid coin movement, there are numerous other valid coin progression output patterns. Similarly, there are numerous invalid signal patterns that are generated when other than a valid coin is progressing through the coin path. Invalid signal patterns may be generated by the wrong size coin, a fraud perpetration device in the coin path, a strung coin, or any other anomaly that is not a valid coin.

One aspect of the invention is the realization that, due to the dynamics of a coin, a coin path, coin spin, stick, and other factors, a coin progressing through the coin path may not always travel straight downward at a constant velocity. As a result, the permutations that may occur with regard to the signals of the coin detectors as the emitter/receiver pairs A–C may assume many different various patterns. Some of these various patterns may be interpreted as a valid coin while others are indicative of an invalid coin. It is contemplated that the coin may bounce in return direction through the coin path or hang at a stationary position for time period and still remain a valid coin. Time parameters of the coin progression may be monitored.

Figure 8:
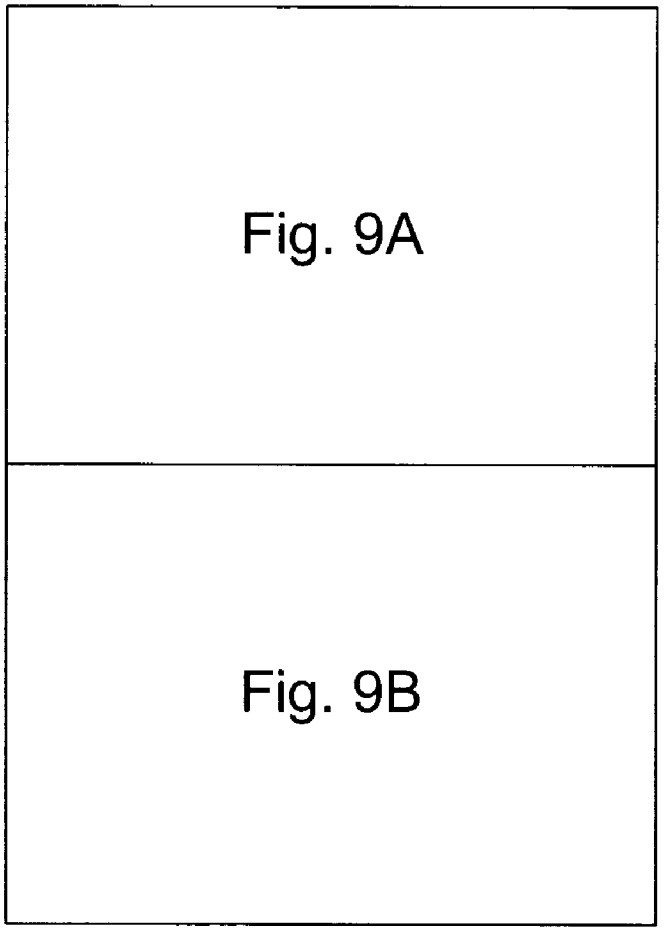
FIG. 8 illustrates a key the association between FIGS. 9A and 9B.
Figure 9A:
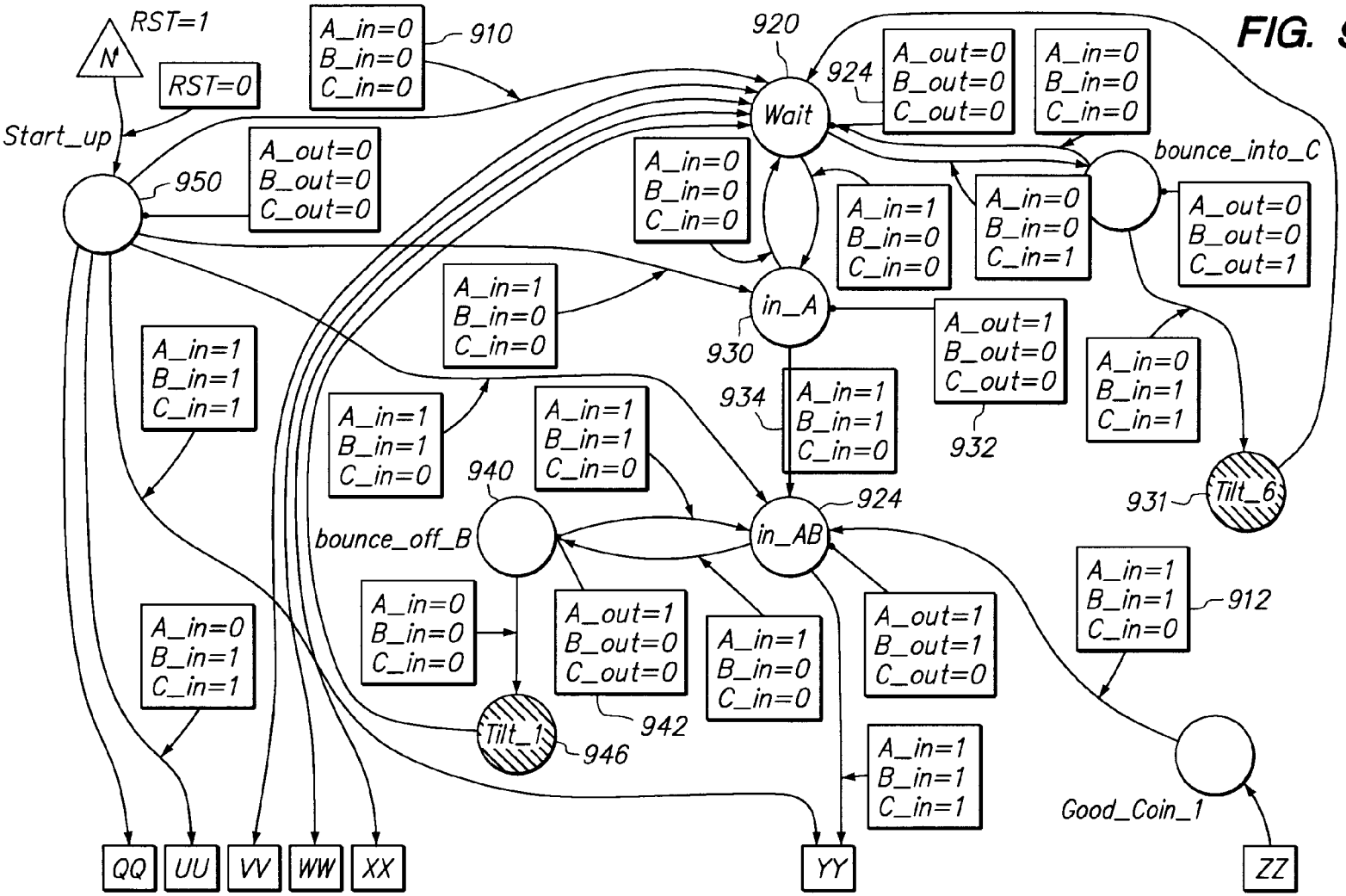
FIGS. 9A and 9B illustrate an exemplary state diagram of coin path.
Figure 9B:
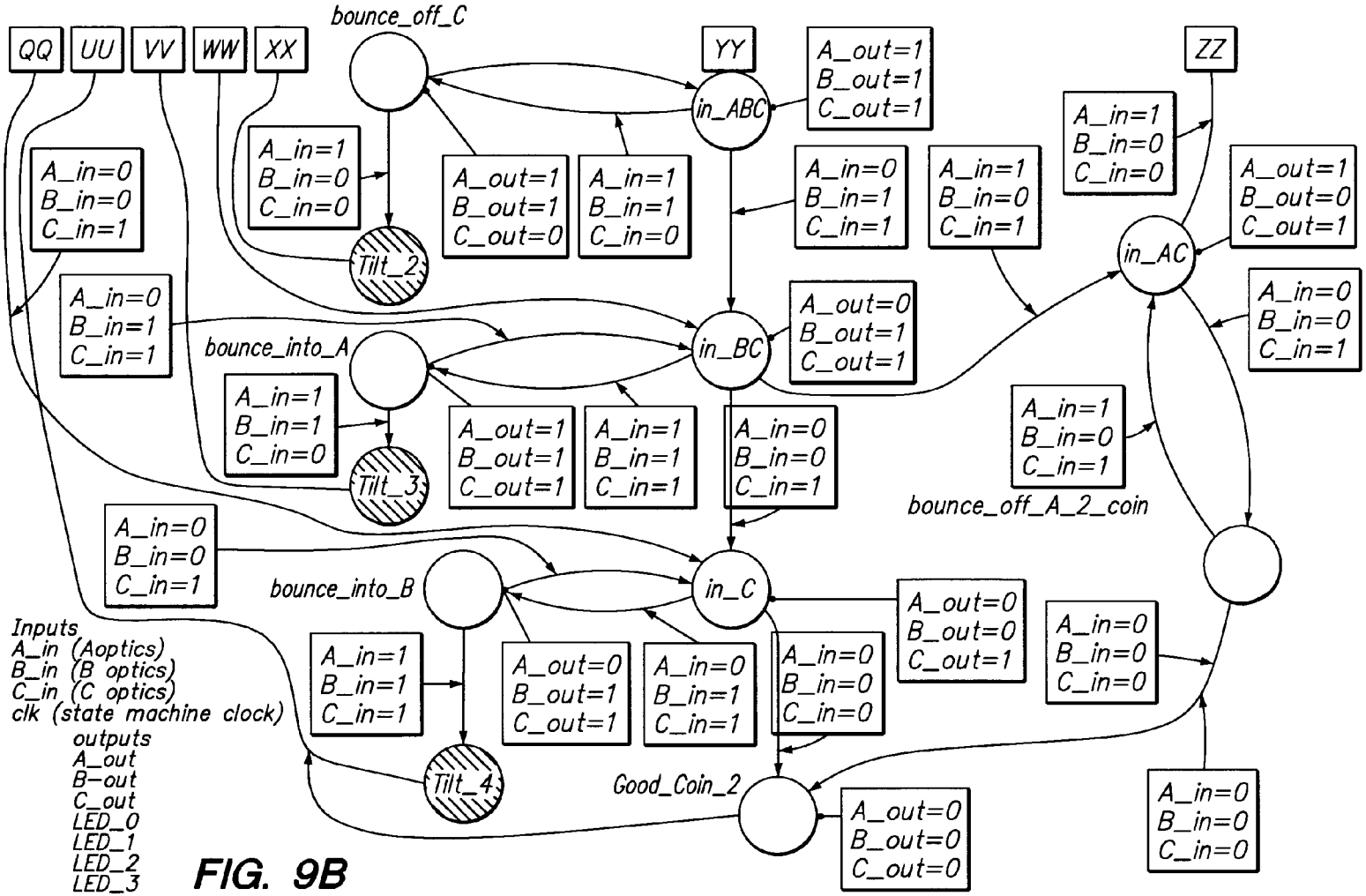

FIG. 8 serves as a key to FIGS. 9A and 9B. FIGS. 9A and 9B illustrates a exemplary state diagram of a valid coin path. It is contemplated that the fraud prevention device herein may optionally include the state diagram implemented in logic, software or any other desire means to monitor the outputs of the emitter/receiver pairs. Discussion of the state table is now provided. Each rectangular symbol provides emitter/receiver pair status. For purpose of FIGS. 9A and 9B, the receiver output of an emitter/receiver pair is referred to as an indicator. In this example state diagram, there are three indicator inputs, indicator A, B, and C. By way of example, status block 910 provides information regarding the status of each indicator. In status block 910, the status of indicators A, B, and C are all receiving, which is to say that a coin is not blocking the path of any indicator. As another example, status block 912 describes indicator A and indicator B as having a coin blocking their path, while indicator C is not blocked by a coin. In addition, FIGS. 9A and 9B include progression circles. Progression circles provide progress information regarding a coin as it moves through each particular stage of the state diagram. Connector line lines connect progression circles as the coins move into and out of indicators A, B, and C. Progression circle 920 is a wait state or a start position. Progression circle 924 provides status of the indicators, i.e. the coin is in or blocking indicators A and B. Progression circle 946 is a tilt block which indicates the coin behavior indicated by path to the tilt block. Based on this information the status of the state table shown in FIGS. 9A and 9B can be understood.

To aid in understanding, a portion of FIGS. 9A and 9B is now described. Starting at a progression circle 920, the table is a wait state or a start state. This state is described in status block 924 which shows the status of indicator A, B, and C. Status block 924 shows the output of A=0, the output of B=0, and the output of C=0. Thus the coin is not blocking any of the indicators A, B, or C. As can be seen the status blocks are associated with a progression circle or a connector line between status blocks. Thus, status block 924 is associated with progression circle 920.

From progression circle 920, the operation may advance to progression circle 930 wherein the coin is now blocking indicator A, but not blocking indicator B or C. This is shown in status block 932. At progression circle 930 it can be seen (based on the arrowed lines) that the coin may proceed downward through the coin path to the state matching progress circle 924 or bounce or spin upward to a return to a state shown by progression circle 920. Status block defines the path between the progression circle 930 and progression circle 920. Note that status block 934 describes the coin moving into state shown progression circle 924, which is the coin is blocking indicators A and B but not blocking indicator C.

At progression circle 924 the coin may advance to progression circle 940, which is described by status block 942. As shown, the coin bounced out of indicator B thereby only blocking indicator A. The coin at progression circle 940 has the option of returning to progress circle 924 or continuing to move upward, which is to say to progress circle 946. If the coin moves to the state shown by progress circle 924, operation continues and a tilt state is avoided. However, if the coin moves out of all the indicators, i.e. A=0, B=0, C=0 at progress circle 946, then a tilt state has occurred. A tilt state is an indication that fraud may be occurring. The coin or token acceptance machine may be made to not grant a credit or shut down. After a tilt state at progress circle 946, the state diagram returns to start state shown by progress circle 920.

Progress circle 950 shows a reset state. When the reset state is entered or enabled, all aspects of the coin monitoring system are reset. This may occur after a fraud detection event. The remaining portions of the figure are not further described as one of ordinary skill in the art will realize the teaching of FIGS. 9A and 9B without further discussion. This is but one possible state diagram or state table that describes the fraud detection possibilities of the present invention.

Figure 10A:
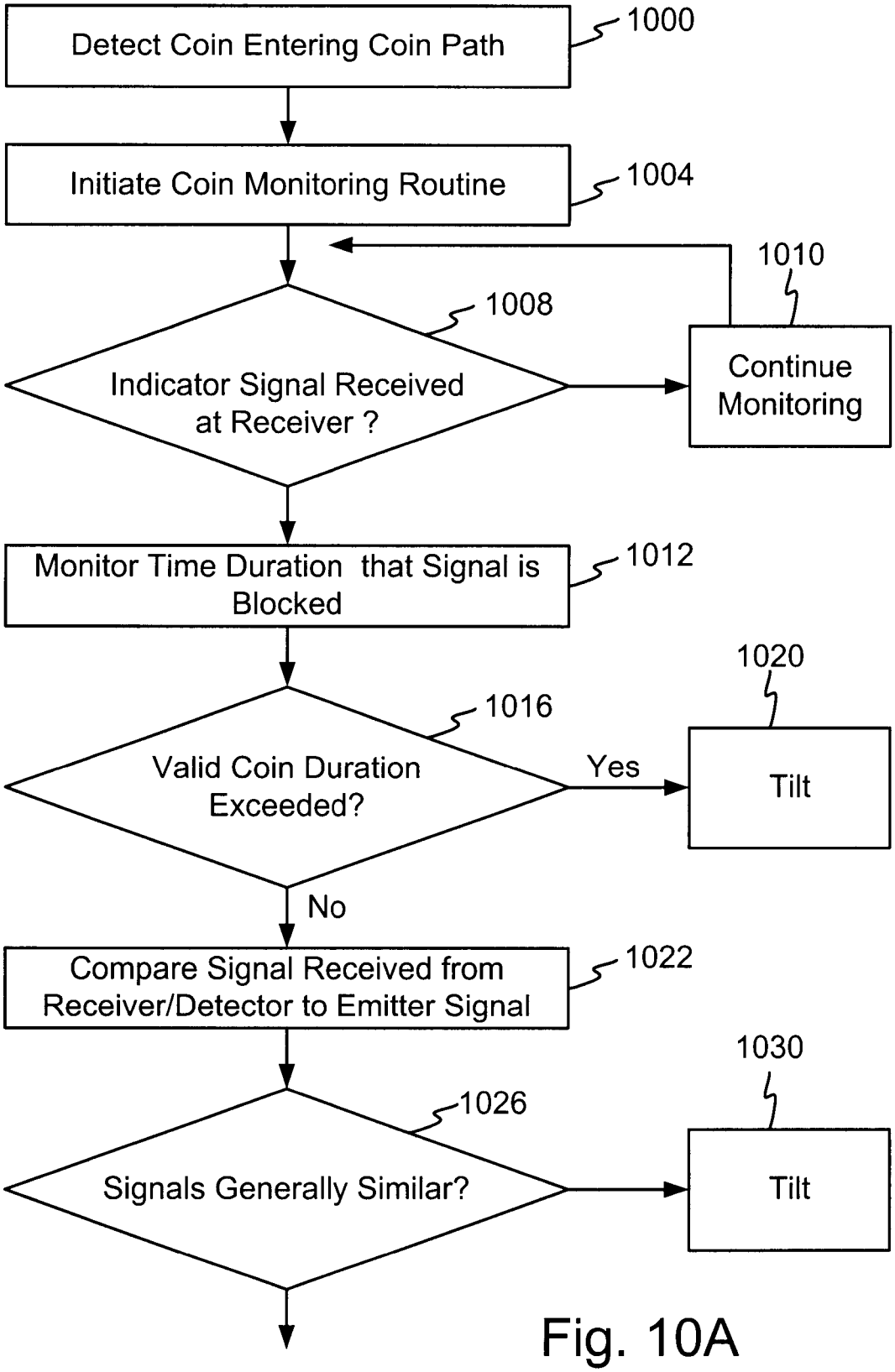
FIGS. 10A and 10B are flow charts illustrating an exemplary method of operation of a device in accordance with the invention.
Figure 10B:
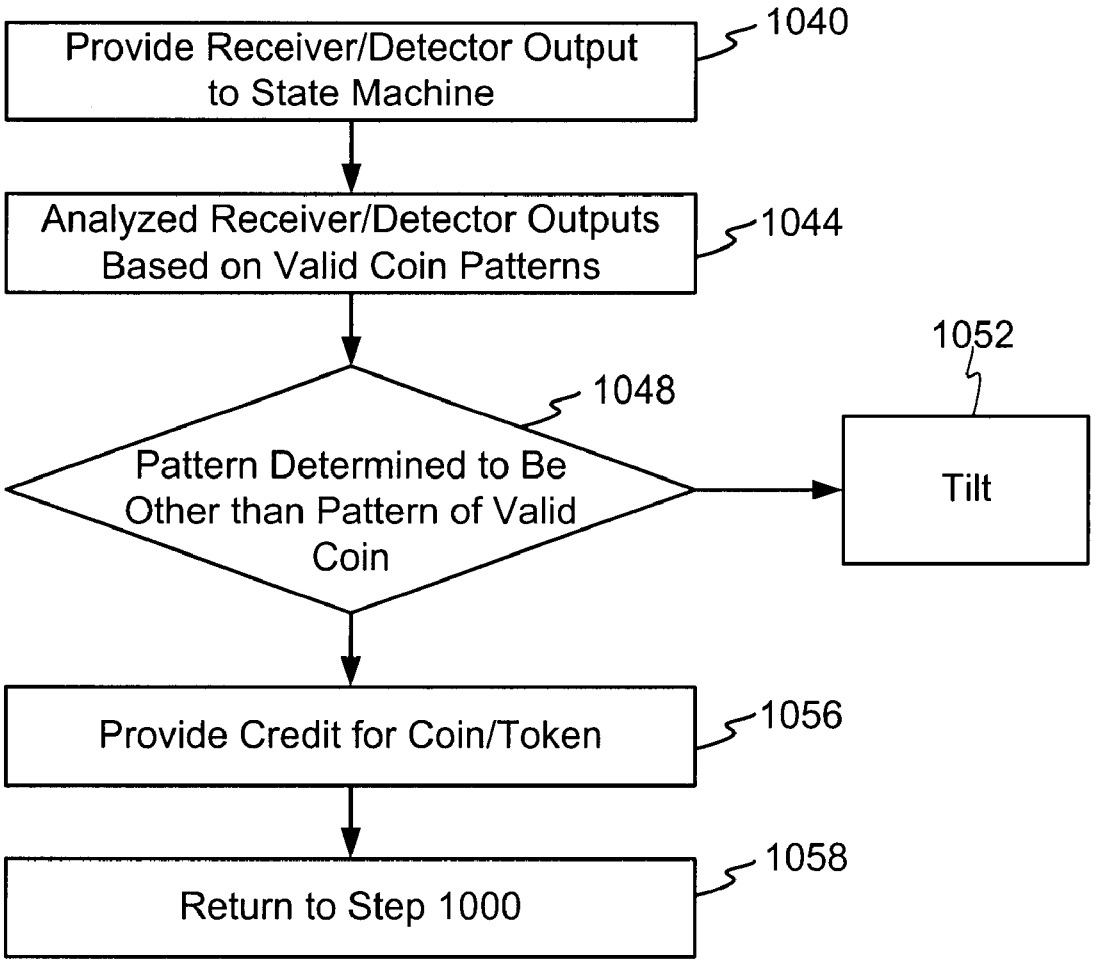

FIGS. 10A and 10B illustrate an example method of operation of an example embodiment of the invention. While this is one general method incorporating fraud prevention operation, it is contemplated that other methods of operation may be incorporated without departing from the scope of the claims. At a step 1000 the system detects a coin entering the coin path. In one embodiment the coin detector performs this task. At a step 1004 the operation initiates the coin monitoring routine. This may be initiated by the detection of the coin at step 1000 or occur continually upon machine start up. At decision step 1008 the system determines if the indicator signal is being received at the receiver/detector. If a signal is being received then the coin has not yet progressed to the first indicator (emitter/receiver pair). If the signal is still being received then the operation advances to step 1010 wherein the monitoring continues and returns to step 1008. An optional timing routine may occur to determine the timing between the detection of the coin at step 1004 and the passage of the coin in front of the first emitter. Monitoring this time may provide another level of fraud detection in that if the time period between coin detection and the coin entering the first emitter then fraud may be occurring.

If at step 1008 the signal sent from the first emitter to the associated receiver is not being received by the associated receiver, then it can be assumed that a coin, obstruction or fraud detection device is blocking its path. At step 1012 the system monitors the duration that signal is blocked. If the signal is blocked for a period longer than it should be blocked for passage of a valid coin then fraud may be occurring. Accordingly at decision step 1016 the operation determines if the time period that the receiver was not receiving a signal exceeded the period for a valid coin. It is contemplated that a range of times required for a valid coin to pass by an emitter can be determined and stored in the control system of the fraud detection system. If at step 1016 the period is exceeded, then the operation progresses to a step 1020 and a tilt state is entered. Alternatively if at step 1016, the time period or duration does not exceed that for a valid coin, then the operation may proceed to step 1022. It is contemplated that each emitter/receiver pair may be monitored on a time basis when a blocked emitter is detected. By monitoring each emitter/receiver pair additional fraud detection is provided.

At step 1022 the system also compares the signal received by the receiver or detector with the signal that is provided to the emitter. By comparing these two signals, it can be detected if the signal that is being sent by the emitter is the same signal that is being received by the receiver/detector. For example if the signals are not the same a fraud may be occurring by the presence of a signal generation device, i.e. fraud generation device. At decision step 1026 the system determines if the signals are the same. If the signals are not the same the operation advances to step 1030 and enters a tilt state. If the outcome of step 1026 is that the compared signals are generally the same, then the operation advances to step 1040 of FIG. 10B.

Steps 1040 through 1052 concern the valid coin patterns and invalid coin patters as defined by a state table as may be implemented in a state machine. At step 1040 the outputs of the receivers/detectors of the emitter/receiver pairs are provided to the state machine or other control, analysis or processing device. At step 1044 the outputs are analyzed based on the valid/invalid coin patterns. A determination is made at decision step 1048 whether the pattern is determined to be other than a valid coin pattern. If the output of the coin detectors is determined to be a invalid coin behavior then the operation progresses to a step 1052 and a tilt state is entered. Alternatively, if at step 1048 the path is determined to be valid, the operation progresses to step 1056 wherein credit is provided for the coin or token as being a valid operation. At step 1058 the operation returns to step 1000 on FIG. 10A and the monitoring for a coin and fraud detection continues.

It will be understood that the above described arrangements of apparatus and the method therefrom are merely illustrative of applications of the principles of this invention and many other embodiments and modifications may be made without departing from the spirit and scope of the invention as defined in the claims.

I claim:

1. A system for detecting fraudulent coin or token submission to a gaming device comprising:

one or more light sources configured to generate light energy;

one or more light detectors configured to detect the presence and absence of the light energy generated by the one or more light sources and convert the detected light energy to a detected electrical signal having a detected modulation pattern;

one or more modulators configured to generate and provide one or more modulated signals having a modulation pattern to the one or more light sources; and a controller connected to at least one of the one or more modulators and at least one of the one or more light detectors, the controller configured to compare the modulation pattern of the one or more modulated signals to the detected electrical signal and output a fraud signal if the detected electrical signal has a detected modulation pattern that is different than the modulation pattern of the one or more modulators.

2. The system of claim 1, wherein the light energy is selected from the group consisting of light in the ultraviolet, infrared, or visible spectrum.

3. The system of claim 1, further including one or more electro-optical convertors between the one or more light detectors and the controller.

4. The system of claim 1, wherein the controller further includes compare logic configured to receive and compare the output from the one or more light detectors with output of the modulator.

5. A method for detecting the possible perpetration of fraud on a gaming machine comprising;

generating a signal that changes over time;

providing the signal to an emitter, the emitter configured to emit energy along an energy path from a first side of a coin path to a second side of the coin path;

receiving with a detector located at the second side of the coin path, the energy emitted along the energy path, during a receiving period, when a coin or token is not blocking the energy path as the coin or token moves through the coin path; and not receiving the energy emitted along the energy path, during a non-receiving period, when a coin or token is blocking the energy path;

analyzing the duration of the receiving period and the duration of the non-receiving period to detect fraud.

6. The method of claim 5, further including generating a fraud indication signal if the comparing reveals that the signal provided to the emitter is not generally identical to a signal representing the energy received at the second side.

7. The method of claim 5, wherein the energy is a light signal and the emitter comprises a light emitting diode.

8. The method of claim 5, wherein the signal that changes over time comprises a frequency modulated signal.

9. The method of claim 5, wherein the signal that changes over time comprises an amplitude modulated signal.

10. The method of claim 5, further including timing the blockage; and comparing the time of the blockage to a stored value.

11. A system for detecting fraudulent coin or token submission to a gaming device comprising:

one or more energy sources configured to emit energy, the energy sources receiving one or more inputs;

one or more energy detectors configured to detect energy emitted from the one or more energy sources and generate one or more detected electrical signals representative of the detected energy;

at least one frequency to voltage convertor configured to generate one or more inputs having voltage levels dependant on a frequency of a controller signal;

a controller configured to receive the detected signal, the controller further configured to compare the one or more inputs to the one or more detected signals and generate an output indicating a fraudulent submission if the one or more inputs are not identical to the one or more detected signals; and a modulator configured to receive the one or more inputs from the controller to the energy sources and provide modulated inputs to the one or more energy sources.

12. The system of claim 11, wherein the energy is selected from the group consisting of light in the ultraviolet, infrared, or visible spectrum.

13. The system of claim 11, further including one or more electro-optical convertors between the one or more light detectors and the controller.

14. The system of claim 11, wherein the controller further includes compare logic configured to receive and compare the output from the one or more light detectors with output of the modulator.

15. A method for detecting passage of other than a valid coin or token in a coin path comprising:

generating one or more signals;

randomly modulating the one or more signals, wherein each signal may have a different random modulation scheme;

providing the one or more modulated signals to one or more emitters configured to emit energy into a coin path;

detecting and receiving energy with one or more receivers located in the coin path;

converting the energy into one or more received signals, the received signals having a received modulation scheme;

comparing the modulation of the one or more signals provided to the one or more emitters to the received modulation scheme; and generating a fraud alert signal if the comparing reveals that the modulation of the one or more signals provided to the one or more emitters is different than the received modulation scheme.

16. The method of claim 15, further including generating a fraud alert if the comparing determines that any one of the one or more modulated signals does not match a corresponding one or the received signals.

17. The method of claim 15, wherein the modulating comprises frequency modulation.

18. The method of claim 15, wherein there are three emitters and three receivers.

19. The method of claim 15, further including randomly changing the modulation scheme based on a random number generator.

20. A fraud prevention system for inclusion in a coin path of a device configured to accept and provide credits for coins or tokens, the system comprising:

a coin path configured to direct a coin to a location for detection by two or more detectors:

two or more detectors located at the location within the coin path, the two or more detectors configured to be activated by the passage of a object to thereby generate outputs indicative of a direction of motion of the object within the coin path; and a comparator configured to compare the outputs of the two or more detectors to two or more valid detector output patterns, that correspond to valid directions of motion of an object, to determine if passage of the object was an event for which credit will be provided based on a direction of motion of the object within the coin path, wherein the two or more detectors comprise one or more pizo-electric devices.

21. The fraud prevention system of claim 20, wherein the valid detector output comprises a range of valid detector outputs generated by activation of the detector by the passage of a valid coin or token.

* * * * *

UNITED STATES PATENT AND TRADEMARK OFFICE

CERTIFICATE OF CORRECTION

PATENT NO. : 6,736,250 B2
DATED : May 18, 2004
INVENTOR(S) : Harold E. Mattice

It is certified that error appears in the above-identified patent and that said Letters Patent is hereby corrected as shown below:

Column 17,
Line 4, please delete "one or the received signals." and replace with -- one of the received signals. --.

Signed and Sealed this

Twenty-first Day of September, 2004

JON W. DUDAS
*Director of the United States Patent and Trademark Office*